United States Patent [19]

Brown, Jr.

[11] 3,954,500

[45] May 4, 1976

[54] DETERGENT COMPOSITIONS AND DISHWASHING METHOD

[75] Inventor: George E. Brown, Jr., Cincinnati, Ohio

[73] Assignee: Safe-Tech, Inc., Cincinnati, Ohio

[22] Filed: June 24, 1974

[21] Appl. No.: 482,479

Related U.S. Application Data

[60] Continuation-in-part of Ser. Nos. 220,476, Jan. 24, 1972, abandoned, and Ser. No. 184,926, Sept. 29, 1971, abandoned, said Ser. No. 220,476, is a division of Ser. No. 79,690, Oct. 9, 1970, abandoned, said Ser. No. 184,926, is a continuation-in-part of Ser. No. 79,690, Oct. 9, 1970, abandoned.

[52] U.S. Cl. ..... 134/25 R; 134/2; 134/25 A; 134/40; 252/89 R; 252/99; 252/132; 252/135; 252/180; 252/DIG. 10; 252/DIG. 11

[51] Int. Cl.[2] ..... A47L 15/14; C11D 3/08; C11D 3/20; C11D 7/26

[58] Field of Search ..... 252/89, 99, 132, 135, 252/180; 260/535 P; 134/2, 25 R, 25 A, 40

[56] References Cited

UNITED STATES PATENTS

| | | | |
|---|---|---|---|
| 2,817,606 | 12/1957 | Barrett | 134/22 |
| 3,459,670 | 8/1969 | Carter | 252/99 |
| 3,544,473 | 12/1970 | Kitchen | 252/99 |
| 3,549,539 | 12/1970 | Mallows | 252/99 |
| 3,627,686 | 12/1971 | Sabatelli | 252/557 |
| 3,630,923 | 12/1971 | Simmons | 252/99 |
| 3,635,830 | 1/1972 | Lamberti | 252/135 |
| 3,640,878 | 2/1972 | Chirash | 252/99 |

FOREIGN PATENTS OR APPLICATIONS

| | | | |
|---|---|---|---|
| 853,647 | 10/1970 | Canada | 252/135 |
| 870,557 | 5/1971 | Canada | 252/135 |
| 941,707 | 2/1974 | Canada | 252/135 |
| 2,150,326 | 4/1972 | Germany | 252/135 |
| 2,111,189 | 5/1972 | France | 252/135 |

*Primary Examiner*—Dennis L. Albrecht

[57] ABSTRACT

Disclosed herein are detergent compositions which include an alkali metal salt, an ammonium salt or mixtures thereof of an oxydipropionic acid and a dishwashing method. No polyphosphates are required.

3 Claims, No Drawings

DETERGENT COMPOSITIONS AND DISHWASHING METHOD

CROSS REFERENCE TO RELATED APPLICATIONS

This application is a continuation-in-part of George E. Brown, Jr. application Ser. No. 220,476 (Jan. 24, 1972), now abandoned, and George E. Brown, Jr. application Ser. No. 184,926 (Sept. 29, 1971), now abandoned, which in turn were, respectively, a divisional application of George E. Brown, Jr. application Ser. No. 79,690 (Oct. 9, 1970), now abandoned, and a continuation-in-part of said 79,690 application.

BACKGROUND OF THE INVENTION AND THE PRIOR ART

In signing the National Environmental Policy Act on Jan. 1, 1970, President Nixon declared that America must reclaim the purity of its air and water. In furtherance of our government's objectives of eliminating pollution a Presidential Commission was appointed to study the causes of pollution and to recommend solutions thereto. On Aug. 10, 1970, their initial report was made public. It included as one recommendation for reclaiming our waters that "polyphosphate builders" be eliminated from detergent compositions.

For a number of years now, the polyphosphates and especially sodium tripolyphosphate (STP) and tetrasodium pyrophosphate (TSPP) have been the backbone of detergent compositions. The role of these builders is a complex one but two of their principal, required functions are to sequester calcium and magnesium salts in the wash water and to enhance the cleaning capabilities of detergent compounds.

Millions of tons of the polyphosphates are sold annually in the United States for use as builders. Sometime during the life span of these detergents they are usually discharged into our nation's lakes and streams.

In recent years a growing amount of evidence has indicated that the polyphosphates have deleterious effects on our streams and lakes. For example, it has been observed that the growth of certain algae in bodies of water is stimulated by the polyphosphates, thus causing serious damage to various kinds of aquatic plants and fish. The algae buildup also produces a very unpleasant sight. And, before too long, conventional water sports are no longer possible.

Prior to the Environmental Act of 1970, one of the largest concerted industrial efforts was instituted to discover a satisfactory, nonpolluting replacement for the polyphosphates in detergent compositions. It is still being actively pursued. Recently, one major seller of cleaning products advertised that it had, without success, spent over three million dollars in an effort to discover such a replacement. Despite this concerted effort, no such replacement has been announced by anyone.

Other builder detergent salts are known or have been announced. Some supposedly present no pollution problems. While they are thus superior to the polyphosphates in that respect they are inferior in other ways. For example, some have been too costly to manufacture, others have failed to function properly as builders, to display the required synergistic action in combination with detergent compounds, and still others have become suspect of producing undesirable side effects.

One builder salt which some detergent manufacturers have recently begun commercially using is the trisodium salt of nitrilotriacetic acid. While the use of this salt has reduced the amounts of polyphosphates required in a particular detergent composition, it has not eliminated the polyphosphates entirely. In such compositions polyphosphates are still employed. Moreover, in recent months some opinions have been expressed that this compound may contribute to the growth of, or cause cancer.

Builder salts other than the alkali metal salts of the aminopolycarboxylic acids have been proposed as polyphosphate replacements. For instance, in Diehl U.S. Pat. No. 3,308,067, a polyphosphate substitute is disclosed. The inventor describes his builder salts as being water soluble salts of polymeric aliphatic polycarboxylic acids. He describes the "essential" structural characteristics of such salts as follows:

1. A minimum molecular weight of about 350 calculated as the acid form.
2. An equivalent weight of about 50 to about 80 calculated as the acid form.
3. At least 45 mole percent of the monomeric species comprising the polymer aliphatic polycarboxylic acid species having at least two carboxyl radicals separated from each other by not more than two carbon atoms.
4. And, the site of attachment to the polymer chain of any carboxyl-containing radical being separated by not more than three carbon atoms along the polymer chain from the site of attachment of the next carboxyl-containing radical.

He points out later in the patent that as the molecular weight decreases below 350, the builder properties decrease substantially.

Still other builder salts have been produced as polyphosphate replacements namely, sodium phytate, the water soluble salts of mehtylene diphosphoric acid, etc. A review of such salts and the patents disclosing them is contained in U.S. Pat. 3,346,873.

Despite the millions of dollars which have been spent in an attempt to discover polyphosphate replacements there has been no compound discovered which favorably compares with the polyphosphates on a price and performance basis and which eliminates the pollution problem. To these ends this invention is directed.

One of the major areas in which phosphates are employed as builders in detergent compositions is in the area of mechanical dishwashing. Millions of pounds of phosphated dishwashing detergent compositions are sold each year for home, restaurant and institutional use. Such compositions customarily contain at least 25% by weight of sodium tripolyphosphate, chlorinated trisodium phosphate and/or tetrasodium pyrophosphate.

The development of mechanical dishwashing detergents began only in recent years. Until the discovery that phosphates could be used as "builders" in dishwashing detergents (U.S. Pat. No. 2,374,100) mechanical dishwashers were not in widespread use. Prior to that time other types of builder salts as for example sodium carbonate, sodium bicarbonate, sodium orthophosphate, and the sodium silicates were available but could not be used in combination with other materials to provide a satisfactory dishwashing composition.

With the introduction of the phosphates into dishwashing detergents in the mid 1930's mechanical dishwashing increased. However, one problem that was encountered and which remained unsolved for more than ten years was of water spotting on glassware and other glass items conventionally washed in the dishwasher. Water spots could only be removed by a hand toweling operation after the washing cycle had been completed. The phenomena of water spotting is very complicated and has been studied at length. One study indicates that water spotting is due to three factors, fat and protein soils, detergent builders, and water hardness.

The role that a "builder salt" plays in a mechanical dishwashing composition is much different from the role it plays in the laundering of clothes in a mechanical washing machine. It is recognized that in a clothes washing bath the surfactant, frequently called the detergent, is the material which is responsible for the cleaning of the laundry. In the washing of dishes however the builder itself exerts a true detersive effect and is the principal "detergent" in the system. For this reason it is recognized that materials which function as builders in clothes washing compositions are not necessarily useful in mechanical dishwashing detergents. This recognition is supported by the history of mechanical dishwashing referred to above wherein it is pointed out that although many builders, useful in clothes washing, were available before sodium tripolyphosphate, none were effective.

In 1956 U.S. Pat. No. 2,756,214 issued and disclosed a mechanical dishwashing composition which substantially reduced water spotting. The composition disclosed therein is a binary mixture of a phosphate builder and chlorinated trisodium phosphate. The patent details the water spotting problems which had been long experienced in the industry.

After the issuance of U.S. Pat. No. 2,756,214 other patents were soon granted directed to the use of other chlorine materials for the purpose of eliminating the water spotting problem and it is generally accepted in the art that in order to prevent water spotting a chlorine material is required.

It is also recognized at this time that unless the composition includes a phosphate builder satisfactory performance cannot be obtained. Recent legislation directed to the elimination of phosphates or the lowering of their levels in commercial products have specifically exempted dishwashing from the ban or the reduction in content because the soap and detergent industry has convinced them that there is no satisfactory substitute for such materials.

Besides a phosphate builder and a chlorine material, most dishwashing detergent compositions include a surfactant. The art recognizes that the most desirable one is a nonionic surfactant. One reason why they are more desirable than other types is that they produce low levels of foam in use. Of course, high levels of foam cannot be tolerated in a dishwasher. Unfortunately, however, nonionic surfactants have had to be carefully selected because many are incompatible with the chlorine materials which are customarily employed in the detergent composition. For this reason, many of the desirable nonionic surfactants cannot be employed.

Overlooking the eutrophication problem for a moment, there is one area in which there exists a need to improve the performance of dishwashing detergent compositions. One recognized problem in the use of the phosphates in dishwashing detergents is that the phosphate has a solubility which is less than the other materials which are customarily employed. For this reason the water to the dishwasher must be as hot as possible so that a satisfactory solution is obtained. It can be appreciated that in many instances such a source of hot water is temporarily unavailable in which event the conventional phosphate dishwashing composition will not be dissolved. It has, therefore, been necessary with the prior art products to maintain the temperature of the water in the dishwasher at between about 140° F. and about 190° F. It will be appreciated also that this required water heating increases the cost of each dishwashing cycle over what it would cost if relatively cool water could be used.

The need for a relatively soluble builder-detergent for dishwashing use arises also through the use of mechanical dispensing equipment frequently employed in restaurants and institutional uses. In use, water is conveyed into the dispenser and mixed with a desired quantity of dishwashing detergent. The water-detergent composition solution is then conveyed to the mechanical dishwasher. In order to be useful in such a system the dishwashing detergent composition must first be soluble in water and secondly the various components in the composition must have approximately the same solubility rates. If such was not the case the solution passing to the dishwasher would contain the individual components in an undesired ratio.

In addition to the foregoing requirements which must be met if a dishwashing composition is to be successful there should also be added the requirement that the material be noncaking. This has been one of the reasons why some materials have not been useful as a complete phosphate replacement in mechanical dishwashing compositions.

Even though a detergent composition meets its intended performance criteria and solves the pollution problem, there is still an important criterion that it should satisfy, namely toxicity. The builders of the present invention when formulated in compositions made in accordance with the following instructions have been determined to be nontoxic as that term is employed in the Federal Hazardous Substances Act.

In view of the foregoing, the following have been important objectives of this invention.

1. To produce phosphate free detergent compositions suitable for many uses including laundry or dishwashing detergents;

2. To produce such a detergent composition which is readily soluble in even cold water;

3. To produce such a detergent composition which includes only a minor number of ingredients and whose manufacture is relatively simple;

4. To produce such a detergent composition which does not need a chlorine material to reduce or to eliminate water spotting;

5. To produce such a detergent composition which is satisfactory for home and commercial, i.e., restaurant, etc., use which may be employed in conventional, automatic dispensing equipment; and 6. To produce such a detergent composition which is nontoxic.

SUMMARY OF THE INVENTION

It has been empirically discovered that the alkali metal salts or ammonium salts of oxydipropionic acid may be used as builder salts in detergent compositions and that phosphates are not required. The oxydipropionic salts (di) function as well as the polyphosphates in detergent compositions. In combination with other ingredients customarily employed in detergent compositions the required synergistic characteristics are exhibited. All of the foregoing performance objectives are met by the compositions of the present invention. Unlike the polyphosphates they do not create any water pollution problems and do not stimulate algae growth. Moreover, it has been determined that compositions specifically described herein employing the disodium salt of oxydipropionic acid as the builder salt are nontoxic within the meaning of the Federal Hazardous Substances Act. This is surprising because a similar composition utilizing the disodium salt of oxydiacetic acid was tested and found to be toxic. The respective acute oral toxicities (LD50) were found to be 5.84 gm/kg and 1.84 gm/kg.

Surprisingly, it has been found that many ingredients having unique performance characteristics may be eliminated in dishwashing detergents and that a binary mixture of the oxydipropionic acid salts (di) and sodium metasilicate function as well as or better than conventional, commercial mechanical dishwashing compositions. Moreover, it has been empirically discovered that the mixtures of this invention are suitable for cold water use, i.e., less than 80° F.

Oxydipropionic acid can react with bases to form two series of salts, a mono salt and a di salt. It is critical to the successful practice of the present invention that the di salts be used. The reason for this criticality is set forth and demonstrated hereinafter.

DESCRIPTION OF THE PREFERRED EMBODIMENTS

The compositions of this invention include: about 20–75% by weight of a di salt of oxydipropionic acid, and the balance of the composition being a compound or compounds normally included in detergent compositions, including dishwashing compositions, including sodium silicate, sodium hydroxide, potassium hydroxide, sodium carbonate, sodium sulfate, sodium tetraborate, borax, sodium carbonate, surfactants, soaps, dyes, perfumes, anticaking agents, chlorine release compounds, antitarnishing compounds, etc.

Those skilled in the art will recognize that since my oxydipropionic salts are replacements for phosphate builder salts they may be substituted for such builder salts, in equal amounts, in conventional detergent compositions.

The surfactant or soap employed is chosen to suit the desired intended end use. For example, for machine dishwashing application, it is well known that surfactants of the nonionic type are useful. For home machine laundry usage a surfactant may be used.

The alkaline materials previously described are conventional ingredients normally added to enhance the cleaning capabilities of the formulation and/or pH of the composition in such. Some, particularly sodium metasilicate, are useful in dishwashing detergents since they inhibit metal corrosion and protect the glaze on china tableware.

The preferred di salt of the present invention is the disodium salt of dipropionic acid.

Table I illustrates examples of compositions formulated in accordance with the invention of this application as employed for dishwashing use and examples of conventional mechanical dishwashing detergent compositions. In the table the following abbreviations have been employed: S.T.P. = sodium tripolyphosphate; CL-T.S.P. = chlorinated trisodium phosphate; S.O.P.A. = the disodium salt of oxydipropionic acid; CDB-59 = a sodium dichloroisocyanurate product sold by Food Machinery Corp.

The conventional nonionic surfactant employed was either a Pluronic or an Igepal material. It is believed that the former are disclosed in U.S. Pat. 2,674,619. The formulas are expressed in terms of percent by weight.

To compare the prior art compositions against those of this application the following tests were performed. Clean dishes and glassware were soiled with "test dirt", i.e., lipstick, peanut butter, margarine, and shortening. The soiled dishes and glassware were washed in a conventional mechanical dishwasher of the type used in homes. The compositions of the Table were used in conventional amounts, and in the conventional way. Visual inspections afterward showed the following.

Examples IA and IIA, produced in accordance with the present invention were compared against Examples I and II, respectively, prior art compositions. Examples IA and IIA removed the lipstick stains much better than Examples I and II. Performance with respect to peanut butter, shortening, margarine and water spotting was about equal, each composition performing satisfactorily.

Examples III, IIIA and IIIB were compared and it was found that IIIA and IIIB removed the lipstick and that III did not. Insofar as the removal of the other materials and the elimination of water spotting, each was satisfactory.

Examples IV and IVA were compared. The former produced greasy films on the dishes and glasses, the lipstick was not removed, and water spotting was noted. The latter removed the lipstick, left a slight film on the glasses, and did not leave a film on the dishes.

Examples V and VA were compared. Example V performed satisfactorily except that the lipstick was not completely removed. The lipstick was removed by Example VA. In all other respects Example VA proved satisfactory.

Examples VI and VIA were compared. The former produced water spots, left a grease film and did not remove the lipstick. Example VIA performed better, eliminating the lipstick but left some film.

Examples VII and VIIA were compared. The latter was superior in removing the peanut butter and lipstick.

Examples VIII and VIIIA were compared. The latter was clearly superior to the former in the prevention of water spotting. In all other respects except lipstick removel the two performed approximately equal. With respect to lipstick removal the former left traces, the latter did not. Example VIIIA was also compared against a formulation like Example VIII except that about 26% CL-T.S.P. was substituted for an equal amount of the S.T.P. The two performed substantially equally. In other tests it has been noted that Example VIIIA compositions do not discolor aluminum utensils or attack chine glazes while Example VIII compositions did.

Example VIIIA has also been tested for commercial use, i.e., in a restaurant. The results were excellent, surpassing those obtained by the use of a leading conventional composition. One dishwasher employed was a commercial Hobart dishwasher. The conditions used were those recommended, i.e., 100 seconds wash and 20 seconds rinse. A conventional mechanical dispensing apparatus was used in other tests. The desired solution was obtained.

Examples VIII and VIIIA were also compared utilizing tepid water, i.e., about 80° F. Example VIII failed to remove almost all of the test dirt. Very little of the composition went into solution. In contrast, all of the Example VIIIA composition was dissolved, all of the dishes and glasses were clean and greaseless. The lipstick was removed. The glasses were virtually spotless. It is believed that this is the first time such results have been obtained under such conditions.

Examples IX and IXA were compared. The former left a film, most of the lipstick, and produced a great deal of water spotting. In contrast, the latter removed all of the lipstick, produced no film, and left only very few water spots. Example IXA could be used as a satisfactory composition for home use, producing results substantially similar to many products on the market today. From a performance standpoint alone, it is believed that Example VIIIA is a slightly better composition.

In addition to the foregoing examples and tests others were formulated and run. For example, S.O.P.A. by itself was tried. While it did display some desired results, the performance was below that of Examples VIIIA and IXA. The inclusion of an amount of a surfactant was found to improve the performance.

In my former application Ser. No. 79,690 there is disclosed a dishwashing detergent consisting of 40% S.O.D.A., 20% sodium silicate, and 40% Orvus AB (a detergent of the linear sodium alkyl benzene sulfonate type). While many performance requirements could be met by this formulation it will be appreciated by those of ordinary skill in the art that if the amount of surfactant is reduced, foaming will also be reduced. In some uses this might be desirable.

It should be noted that instead of S.O.P.A. shown in the Table for use in accordance with this invention, the other alkali metal salts (di) or the ammonium salt (di) of dipropionic acid may be utilized.

In compounding the dishwashing compositions mixtures of the present invention, no special techniques are employed or required. Conventional mixing and blending techniques may be employed. The resultant final product has been found to be dry and free flowing even after lengthy storage periods. No caking has been noted.

The following examples, Examples X- , illustrate the use of the present detergent compositions as laundry detergents in mechanical washing machines. Excellent results may be obtained if the detergent compositions are added in amounts recommended by the manufacturer for conventional detergent compositions.

EXAMPLE X

An excellent detergent composition giving outstanding results in cloth washing has the following composition in the percentages (by weight) indicated.

| | |
|---|---|
| A detergent, for example Orvus AB — a detergent of the linear sodium alkyl benzene sulfonate type | 45 |
| Disodium salt of oxydipropionic acid | 45 |
| Sodium silicate ($Na_2O:SiO_2$=1:1) | 10 |

EXAMPLE XI

An excellent detergent composition may be formulated from the following materials in the percentages (by weight) indicated.

| | |
|---|---|
| A soap consisting basically of potassium palmitate | 40 |
| The disodium salt of oxydipropionic acid | 50 |
| Sodium silicate ($Na_2O:SiO_2$=1:1) | 10 |

EXAMPLE XII

The salt of the oxydipropionic acid need not be the sodium salt as illustrated in the foregoing examples. It may be the salt of the other alkali materials or of ammonium. For instance, a detergent composition may be formulated using the diammonium salt of oxydipropionic acid of Example X or XI.

In order to test the effectiveness of the detergent compositions the following tests were made comparing them to conventional detergent compositions.

Towels having been treated with a standard dirt composition were used for test pieces. The washing cycles used for test purposes, the concentrations used, etc., were closely controlled so that the difference in cleanliness, etc., could only be attributable to the detergent composition utilized.

The standard dirt compound was made from one gallon of water, 20 grams of carbon black (of 325 mesh or better), 250 grams of soil, and 50 grams of castor oil. This standard dirt compound was made by mixing the latter three materials with a small amount of water in a Waring blender for five minutes and then mixing the resultant mixture with the remainder of the water.

The white towels used as test samples were previously washed to remove the sizing and fabric conditioners. The test towels were dipped immediately into the standard dirt compound after it was prepared. The towels were then dried before they were washed with the various detergent compositions.

In test 1 a test towel, designated TT1, was washed in a conventional detergent composition consisting of 45% by weight of a detergent, 45% by weight of a builder salt and 10% by weight sodium silicate (1:1 ratio). The builder salt was sodium tripolyphosphate, and the detergent was Orvus AB, a linear sodium alkyl benzesulfonate. The towel washed with this detergent composition was used as one standard for comparing the effectiveness of the detergent compositions produced in accordance with the invention disclosed herein.

Another standard towel, TT2, was washed with another conventional detergent composition consisting essentially of 40% by weight Orvus AB, 30% by weight STP, 20% by weight NTA and 10% by weight of sodium silicate.

A test towel, TT3, was washed with a detergent composition formulated in accordance with Example X hereof. TT3 was compared with TT1 and was found to be as white as the standard towel. The amount of soil removed from TT3 was about equal to the amount of soil removed from TT1. The two towels appeared to have been washed with the same detergent composition.

A detergent composition formulated in accordance with Example XII was used to wash another test towel, TT4. As before, soil removal, whiteness maintenance and general cleaning power appeared to be about equal between TT4 and TT1. The general appearance of the two towels appeared to be the same.

In addition to the various materials which may be added to the detergent compositions as enumerated above, it was found that the builder salts disclosed herein seem to function extremely well with minor amounts of trisodium nitrilotriacetate.

EXAMPLE XIII

It has been found that an excellent detergent composition may be formulated from about 30% by weight of the disodium salt of oxydipropionic acid, 40% by weight of Orvus AB or the equivalent, about 20% by weight of NTA and about 10% by weight of sodium silicate. A test towel washed with such a composition, TT6, was compared with a test towel, TT7, washed with an identical composition except that STP was used in place of the disodium salt of oxydipropionic acid. Soil removal, whiteness and general cleaning power were equal for the two compositions.

TABLE I

| EXAMPLE I | | EXAMPLE IA | |
|---|---|---|---|
| S.T.P. | 45.0 | S.O.P.A. | 45.0 |
| $Na_2SiO_3$ | 14.0 | $Na_2SiO_3$ | 14.0 |
| CL-T.S.P. | 10.0 | Nonionic Surfactant | 3.0 |
| Nonionic Surfactant | 3.0 | S.O.D.A.-NaOCl | 10.0 |
| Water to 100% | | Water to 100% | |

| EXAMPLE II | | EXAMPLE IIA | |
|---|---|---|---|
| S.T.P. | 45 | S.O.P.A. | 45 |
| CDB-59 | 3.5 | CDB-59 | 3.5 |
| $Na_2SiO_3$ | 20 | $Na_2SiO_3$ | 20.0 |
| Nonionic Surfactant | 3.5 | Nonionic Surfactant | 3.5 |
| $Na_2SO_4$ | 15.5 | $Na_2SO_4$ | 15.5 |
| Water to 100% | | Water to 100% | |

| EXAMPLE III | | EXAMPLE IIIA | | EXAMPLE IIIB | |
|---|---|---|---|---|---|
| S.T.P. | 45.0 | S.O.P.A. | 63 | S.O.P.A. | 45 |
| $Na_2SiO_3$ | 18 | $Na_2SiO_3$ | 18 | $Na_2SiO_3$ | 18 |
| CL-T.S.P. | 18 | $Na_2CO_3$ | 5 | CL-T.S.P. | 18 |
| $Na_2CO_3$ | 5 | Nonionic Surfactant | 3 | $Na_2CO_3$ | 5 |
| Nonionic Surfactant | 3 | Water to 100% | | Nonionic Surfactant | 3 |
| Water to 100% | | | | Water to 100% | |

| EXAMPLE IV | | EXAMPLE IVA | |
|---|---|---|---|
| $Na_2CO_3$ (light) | 22.5 | $Na_2CO_3$ (light) | 22.5 |
| NaOH | 19.5 | NaOH | 19.5 |
| $Na_2CO_3$ (dense) | 21.5 | $Na_2CO_3$ (dense) | 21.5 |
| S.T.P. | 34.5 | S.O.P.A. | 34.5 |
| Nonionic Surfactant | 2.0 | Nonionic Surfactant | 2.0 |

| EXAMPLE V | | EXAMPLE VA | |
|---|---|---|---|
| S.T.P. | 50 | S.O.P.A. | 50 |
| $Na_2SiO_3$ | 35 | $Na_2SiO_3$ | 35 |
| $Na_2CO_3$ | 9 | $Na_2CO_3$ | 9 |
| Nonionic Surfactant | 1 | Nonionic Surfactant | 1 |
| CDB-59 | 1 | CDB-59 | 1 |
| $NaAl_3H_{14}(PO_4)_8/4H_2O$ | 4 | $NaAl_3H_{14}(PO_4)_8/4H_20$ | 4 |

| EXAMPLE VI | | EXAMPLE VIA | |
|---|---|---|---|
| Sodium Tetraborate-$5H_2O$ | 35 | Sodium Tetraborate | 35.0 |
| S.T.P. | 28.5 | S.O.P.A. | 28.5 |
| Sodium Bisulfate | 30.0 | Sodium Bisulfate | 30.0 |
| Urea | 0.5 | Urea | 0.5 |
| CDB-59 | 5 | CDB-59 | 5.0 |
| Nonionic Surfactant | 1 | Nonionic Surfactant | 1 |

| EXAMPLE VII | | EXAMPLE VIIA | |
|---|---|---|---|
| S.T.P. | 46 | S.O.P.A. | 46 |
| Nonionic Surfactant | 3 | Nonionic Surfactant | 3 |
| Sodium Tetraborate | 27 | Sodium Tetraborate | 27 |
| $Na_2SiO_3$ | 22 | $Na_2SiO_3$ | 22 |
| CDB-59 | 2 | CDB-59 | 2 |

| EXAMPLE VIII | | EXAMPLE VIIIA | |
|---|---|---|---|
| S.T.P. | 66 | S.O.P.A. | 66 |
| $Na_2SiO_3$ | 33 | $Na_2SiO_3$ | 33 |
| Nonionic Surfactant | 1 | Nonionic Surfactant | 1 |

| EXAMPLE IX | | EXAMPLE IXA | |
|---|---|---|---|
| S.T.P. | 65 | S.O.P.A. | 65 |
| $Na_2SiO_3$ | 35 | $Na_2SiO_3$ | 35 |
| No Surfactant | | No Surfactant | |

Having thus described my invention, I claim:

1. A method of washing eating utensils and tableware which comprises subjecting them to an agitated aqueous solution of a detergent composition consisting essentially of about 20–75% of the dialkali metal salts of oxydipropionic acid, the diammonium salts of oxydipropionic acid and mixtures thereof, and about 10–50% by weight of sodium metasilicate.

2. The method of claim 1 wherein said composition includes about 0.5% to 2% by weight of a low foaming surfactant.

3. The method of claim 1 wherein said aqueous solution has a temperature of less than 120° F.

* * * * *